US008864983B2

(12) United States Patent
Ng et al.

(10) Patent No.: US 8,864,983 B2
(45) Date of Patent: Oct. 21, 2014

(54) NAPHTHA BASED FUNGIBLE BITUMEN PROCESS

(75) Inventors: Yin Ming Samson Ng, Sherwood Park (CA); Brian Knapper, Edmonton (CA); Jim Kresta, Edmonton (CA)

(73) Assignee: Syncrude Canada Ltd., Fort McMurray (CA)

( * ) Notice: Subject to any disclaimer, the term of this patent is extended or adjusted under 35 U.S.C. 154(b) by 136 days.

(21) Appl. No.: 13/422,858

(22) Filed: Mar. 16, 2012

(65) Prior Publication Data

US 2013/0240412 A1 Sep. 19, 2013

(51) Int. Cl.
*C10G 1/04* (2006.01)

(52) U.S. Cl.
USPC ..... 208/390; 208/311; 208/314; 208/321; 208/339

(58) Field of Classification Search
CPC ..... C10G 1/04; C10G 17/04; C10G 21/14; C10G 21/02
USPC ..... 208/311, 314, 321, 339, 390
See application file for complete search history.

(56) References Cited

U.S. PATENT DOCUMENTS 3,884,829 A * 5/1975 Moyer ..... 516/181
3,901,791 A * 8/1975 Baillie ..... 208/188
6,746,599 B2 6/2004 Cymerman et al.
2008/0110281 A1* 5/2008 Sanders et al. ..... 73/861.63
2010/0012555 A1 1/2010 Moran et al.
2011/0278240 A1* 11/2011 Hann et al. ..... 210/803

FOREIGN PATENT DOCUMENTS

CA 2262048 8/2000

OTHER PUBLICATIONS

Speight, J.G. (2007). The Chemistry and Technology of Petroleum, 4th edition, Marcel-Dekker, 984 pgs (Office action references p. 153).*
Czarnecki, J. and Moran, K. On the Stabilization Mechanism of Water-in-Oil Emulsions in Petroleum Systems. Energy & Fuels. 2005. pp. 2074-2079. vol. 19.
Kotlyar, L.S., et al. Solids Associated with the Asphaltene Fraction of Oil Sands Bitumen. Energy & Fuels. 1999. pp. 346-350. vol. 13(2).
Renouf, G., et al. The Impact of Changing Canadian Pipeline BS&W Specifications: A Survey. Petroleum Society of CIM. Oct. 1997. Paper No. 97-179.
Yang, X. and Czarnecki, J. The Effect of Naphtha to Bitumen Ratio on Properties of Water in Diluted Bitumen Emulsions. Physicochem. Eng. Aspects. 2002. pp. 213-222. vol. 211.

* cited by examiner

*Primary Examiner* — Brian McCaig
(74) *Attorney, Agent, or Firm* — Bennett Jones LLP

(57) ABSTRACT

The invention is directed to a process for cleaning bitumen froth by mixing a sufficient amount of naphtha with the bitumen froth to provide a naphtha-to-bitumen ratio within the range of about 4.0 (w/w) to about 10.0 (w/w) and separating substantially dry diluted bitumen from the water and solids. Also provided is a process for cleaning diluted bitumen by mixing a sufficient amount of naphtha with the diluted bitumen to provide a naphtha-to-bitumen ratio equal to or greater than about 1.8 (w/w) and separating marketable fungible raw bitumen from the water and solids.

23 Claims, 5 Drawing Sheets

NAPHTHA BASED FUNGIBLE BITUMEN PROCESS

FIELD OF THE INVENTION

The present invention relates generally to the field of oil sands processing, particularly to processes of cleaning bitumen froth or diluted bitumen using naphtha.

BACKGROUND OF THE INVENTION

Oil sand deposits such as those found in the Athabasca Region of Alberta, Canada, generally comprise water-wet sand grains held together by a matrix of viscous heavy oil or bitumen. Bitumen is a complex and viscous mixture of large or heavy hydrocarbon molecules which contain a significant amount of sulfur, nitrogen and oxygen. Oil sands processing involves extraction and froth treatment to produce diluted bitumen which is further processed to produce synthetic crude oil and other valuable commodities. Extraction is typically conducted by mixing the oil sand in hot water and aerating the resultant slurry to promote the attachment of bitumen to air bubbles, creating a lower-density bitumen froth which floats and can be recovered in a separator such as a gravity separator or cyclonic separator. Bitumen froth may contain about 60 wt % bitumen, about 30 wt % water and about 10 wt % solid mineral material, of which a large proportion is fine mineral material. The bitumen which is present in a bitumen froth comprises both non-asphaltenic material and asphaltenes.

Froth treatment is the process of eliminating the aqueous and solid contaminants from the bitumen froth to produce a clean bitumen product (i.e., "diluted bitumen") for downstream upgrading processes. The bitumen froth is diluted with a hydrocarbon solvent to reduce the viscosity and density of the oil phase, thereby accelerating the settling of the dispersed phase impurities by gravity or centrifugation. Either a paraffinic or naphthenic type diluent may be used. Examples of paraffinic type diluents include C4 to C8 aliphatic compounds and natural gas condensate, which typically contains short-chained aliphatic compounds and may also contain small amounts of aromatic compounds. Examples of naphthenic type diluents include toluene (a light aromatic compound) and naphtha, which may be comprised of both aromatic and non-aromatic compounds. The difference in the bitumen produced by use of either a paraffinic or naphthenic type diluent can be attributed largely to the presence of aromatics. Aromatics have the ability to hold asphaltenes in solution, whereas paraffinic type diluents cause asphaltene precipitation.

Use of paraffinic type diluents results in a relatively low bitumen recovery (generally about 90%), but in a bitumen product which is dry, light, and has a relatively low water and solids concentration (less than about 0.5 wt %). However, paraffinic type diluents precipitate a major proportion of asphaltenes from the bitumen froth, resulting in not only the trapping of water and solids by the asphaltenes, but also high bitumen losses (about 8%) to froth treatment tailings. There are both environmental incentives and economic incentives for recovering all or a portion of this residual bitumen.

In comparison, the use of naphthenic type diluents results in a relatively high bitumen recovery (generally greater than about 98%), but in a bitumen product which has relatively high water (about 2 to 4 wt %) and solids (about 0.5 to 1.0 wt %) concentrations. The combined water and solids concentration typically is greater than about 2.5 wt %. Due to the level of contamination which pose fouling and corrosion problems, the diluted bitumen is not suitable for direct pipelining to conventional refineries, cannot be sold to the open market, and must be upgraded using processes such as a coker or hadrocracker. The upgraded products are then hydrotreated to produce synthetic crude oil. In order for the diluted bitumen to be marketable, it must meet the pipeline quality specifications, i.e. <0.5 vol % BS&W, density of 940 kg/m3 at 15° C. and viscosity of 350 cSt (mm2/s) at 6° C.

The inability to produce marketable diluted bitumen product from conventional naphtha-based processes is an impediment to the oil sands industry. The opening of future mines creates a potential scenario that the current bitumen processing capacity may be insufficient to handle the quantity of bitumen product. The ability to produce marketable fungible bitumen from conventional naphtha-based processes would greatly enhance the flexibility of production operations.

SUMMARY OF THE INVENTION

The present invention relates generally to processes of cleaning bitumen froth or diluted bitumen using naphtha.

In one aspect, the invention comprises a process for cleaning bitumen froth comprising: mixing a sufficient amount of naphtha with the bitumen froth to provide a naphtha-to-bitumen ratio within the range of about 4.0 (w/w) to about 10.0 (w/w); and subjecting the resulting mixture to gravity settling or centrifugal separation to yield a hydrocarbon phase comprising substantially dry and solids free diluted bitumen, and a separate water/solids phase. In one embodiment, the diluted bitumen comprises a water concentration between about 0.01 wt % to about 0.35 wt %.

In one embodiment, the naphtha-to-bitumen ratio is about 10 (w/w). In one embodiment, the hydrocarbon phase is separated from the water/solids phase through gravity settling. In one embodiment, the diluted bitumen comprises about 0.01 wt % water or less.

In another aspect, the invention comprises a process for cleaning diluted bitumen comprising: mixing a sufficient amount of naphtha with the diluted bitumen to provide a naphtha-to-bitumen ratio equal to or greater than about 1.8 (w/w); and subjecting the resulting mixture to gravity settling or centrifugal separation to yield a hydrocarbon phase comprising bitumen product, and a separate water/solids phase. In one embodiment, the diluted bitumen feed comprises about 2 wt % water and about 1 wt % solids.

In one embodiment, the hydrocarbon phase is separated from the water/solids phase through gravity settling. In one embodiment, gravity settling is conducted for about 20 minutes to about 2 hours. In one embodiment, the bitumen product comprises about 0.017 wt % water or less and about 0.09 wt % solids or less.

For the purposes of the present invention, the term "fungible bitumen" is defined as a diluted bitumen product wherein the sum of water and solids content is less than about 0.5 vol % to allow the hydrocarbon product to be able to be shipped down a pipeline to a conventional refinery.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practised without these specific details.

The present invention relates generally to processes of cleaning bitumen froth or diluted bitumen using naphtha. In one aspect, the present invention relates to a process for bitumen froth cleaning which yields a fungible diluted bitumen amenable to downstream upgrading processes. To meet specification requirements, the fungible diluted bitumen must have a water and solids concentration of less than 0.5 vol %.

Optimum naphtha-to-bitumen ratios have been identified for the effective treatment of bitumen froth produced from oil sands. The amount of naphtha is significant with respect to the amount of bitumen. A desired flow rate of bitumen froth is set and the required naphtha to meet the naphtha-to-bitumen ratio is calculated. The bitumen froth is used as the feed to the process of the present invention, and is directly fed with naphtha at the desired naphtha-to-bitumen ratio.

A combination of the naphtha-to-bitumen ratios and separation is applied to separate the desired diluted bitumen from water and contaminants. Typically, separation may be conducted by centrifugation in a sequence of scroll and disc centrifuges, or gravity settling in a series of inclined plate separators ("IPS"). The effectiveness of the treatment is assessed in terms of the water and solids concentration of the diluted bitumen.

As described in Example 1, below, the results from an experimental run indicate that as the naphtha-to-bitumen ratio increases, the percent water in the diluted bitumen decreases. In one embodiment, the naphtha-to-bitumen ratio is in the range of between about 4.0 (w/w) to about 10.0 (w/w). Separation comprises either gravity settling or centrifugal separation. This range of ratios and separation yields diluted bitumen containing about 0.01 wt % to about 0.35 wt % water. Preferably, the naphtha-to-bitumen ratio is about 10.0 (w/w), and separation comprises gravity settling to yield diluted bitumen containing about 0.01 wt % water.

Figure 1:
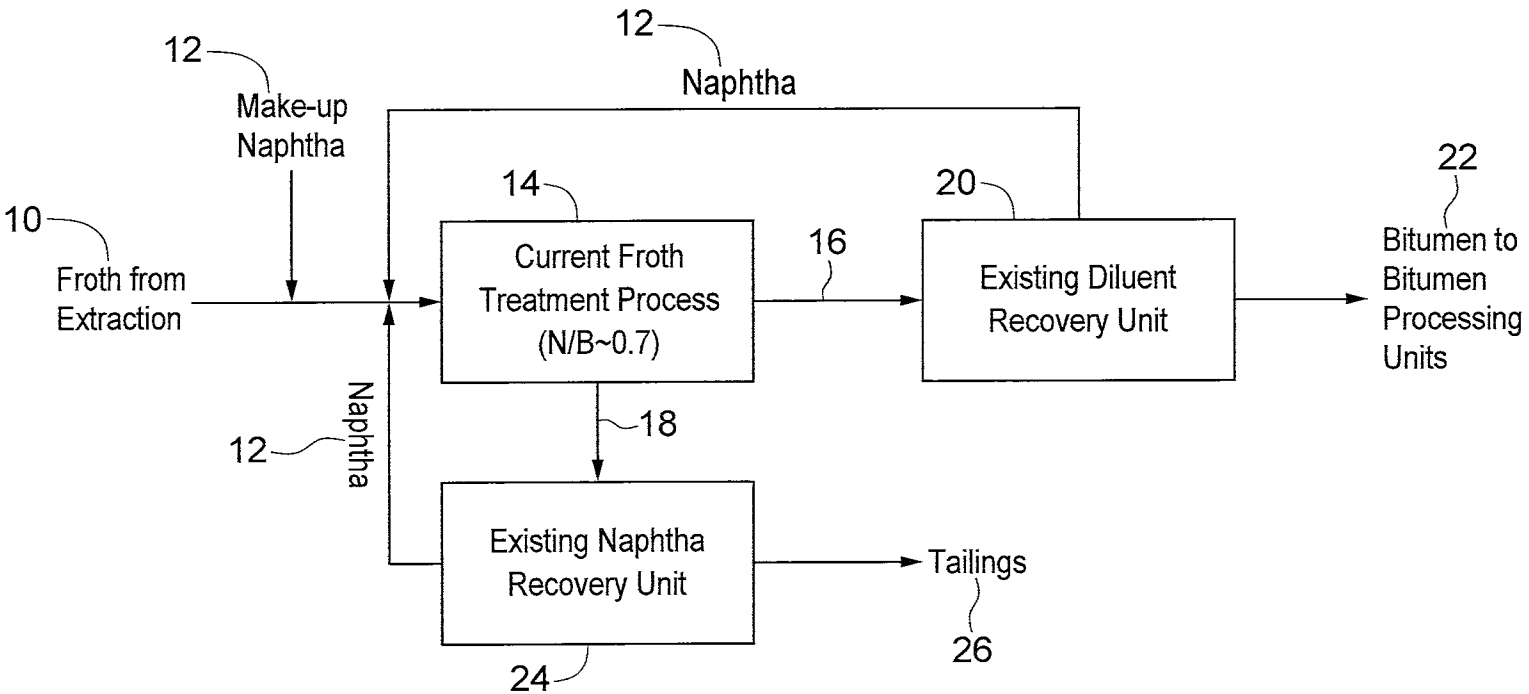
FIG. 1 is a schematic of a prior art process for cleaning bitumen froth obtained from oil sand extraction.

In another aspect, the present invention uses diluted bitumen obtained from a conventional froth treatment process as the feed. A conventional froth treatment process is shown in FIG. 1. For example, the diluted bitumen may be obtained from an IPS unit. A typical IPS product comprises about 2-4 wt % water and 1-2 wt % solids. The diluted bitumen is directly fed with naphtha at the desired naphtha-to-bitumen ratio, and gravity settling or centrifugal separation is conducted to produce marketable fungible raw bitumen.

As described in Example 2, below, the results from an experimental run indicate that as the naphtha-to-bitumen ratio increases, the percent water in the fungible bitumen product decreases. In one embodiment, the naphtha-to-bitumen ratio is equal to or greater than about 1.8 (w/w), and separation comprises gravity settling to yield a fungible bitumen product containing less than about 0.5 wt % water.

Without being bound by theory, the application of the above naphtha-to-bitumen ratios has the effects of partially precipitating a portion of the asphaltenes and solids associated with asphaltene, and changing the hydrocarbon fluid properties such as for example, reducing the viscosity and density for better water and solids separation. As the emulsified water is known to be stabilized by asphaltenes and solids, these effects induced by the naphtha-to-bitumen ratios significantly reduce the emulsified water present in diluted bitumen, producing high quality fungible bitumen.

It will be appreciated by those skilled in the art that the processes of the present invention may entirely replace or be incorporated into conventional processes. FIG. 1 is a schematic of a typical process for froth treatment. Extraction bitumen froth (10) is mixed with a sufficient amount of naphtha (12) to produce a naphtha-to-bitumen ratio of about 0.7 (w/w). The resulting mixture is subjected to either gravity settling or centrifugal separation (14) to yield a diluted bitumen component (16) and a diluted tailings component (18). Each component is subjected to a naphtha recovery process. Recovery of the naphtha from the diluted bitumen component in a recovery unit (20) is required before the bitumen may be delivered to a refinery for further processing (22). Recovery of the naphtha from the diluted tailings component in a recovery unit (24) is desirable to avoid discarding flammable, carcinogenic solvent with the tailings (26) in a tailings pond and to minimize expenditures for fresh solvent.

Figure 2:
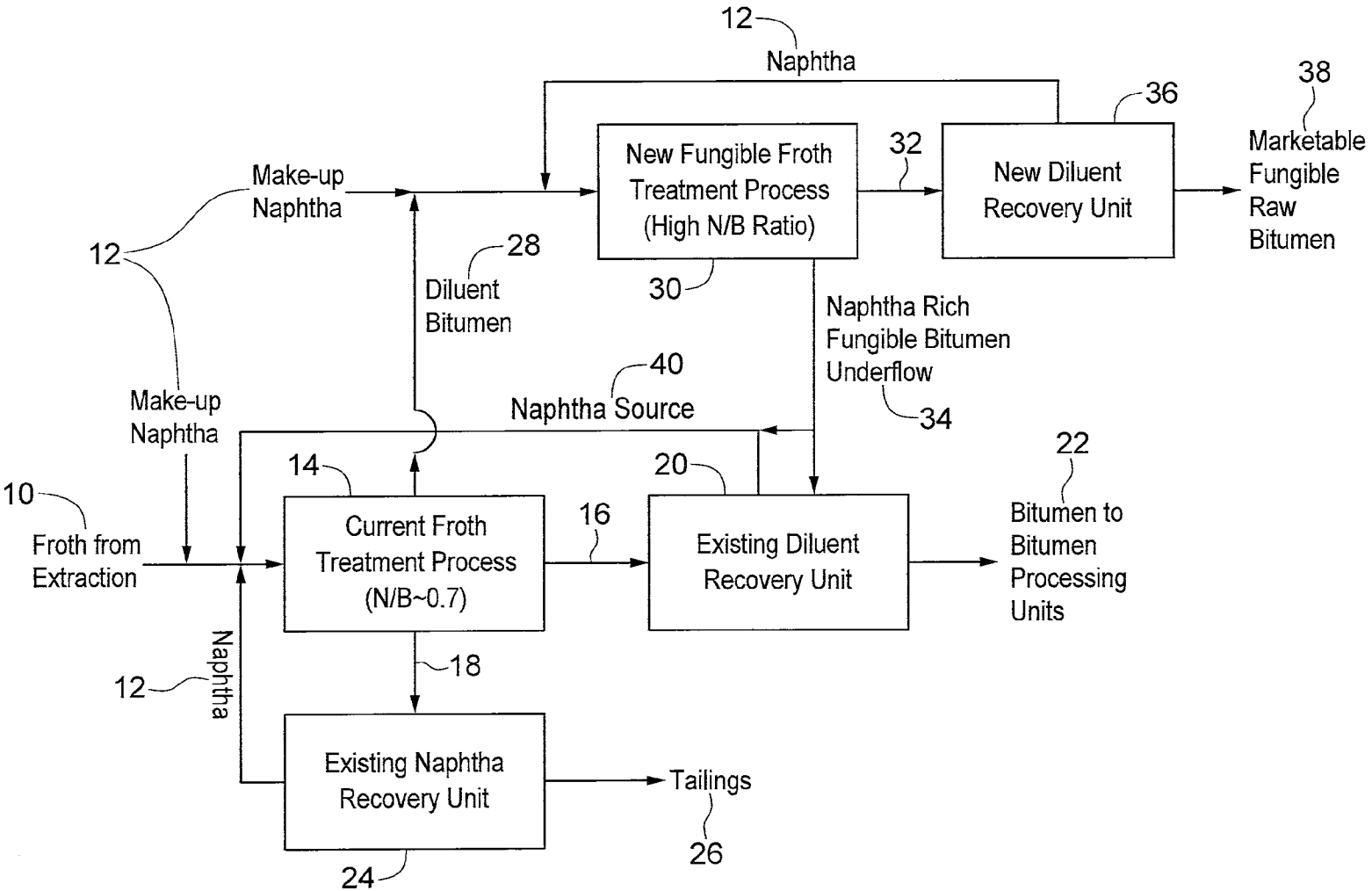
FIG. 2 is a schematic of one embodiment of the present invention for cleaning diluted bitumen obtained from the process of FIG. 1.

FIG. 2 is a schematic of one embodiment of the process of the present invention for treating diluted bitumen obtained from the process line of FIG. 1 (i.e., an intermediate stream from current froth treatment process) in order to produce marketable fungible raw bitumen. The diluted bitumen (28) is used as the feed in the process of the present invention. The diluted bitumen (28) is directly fed with a sufficient amount of naphtha (12) to produce a naphtha-to-bitumen ratio equal to or greater than about 1.8 (w/w). The resulting mixture is subjected to either gravity or centrifugal separation (30). Preferably, gravity settling is carried out using an inclined plate separator to produce an overhead stream of further diluted bitumen component (32) and a naphtha-rich underflow stream (34). Recovery of the solvent from the diluted bitumen component in a recovery unit (36) is conducted. Then, light hydrocarbon, e.g., condensate or synthetic crude, is added to the product of recovery unit (36) before the marketable fungible raw bitumen is delivered to a pipeline or refinery (38), thereby meeting the required density and viscosity specification for the pipeline product. The naphtha-rich underflow stream (34) may be recycled as a source of naphtha (40), or combined with either fresh froth feeding to another processing unit (for example, a Bird centrifuge, ANDRITZ AG, Graz, Austria) or other froth treatment product.

Figure 3:
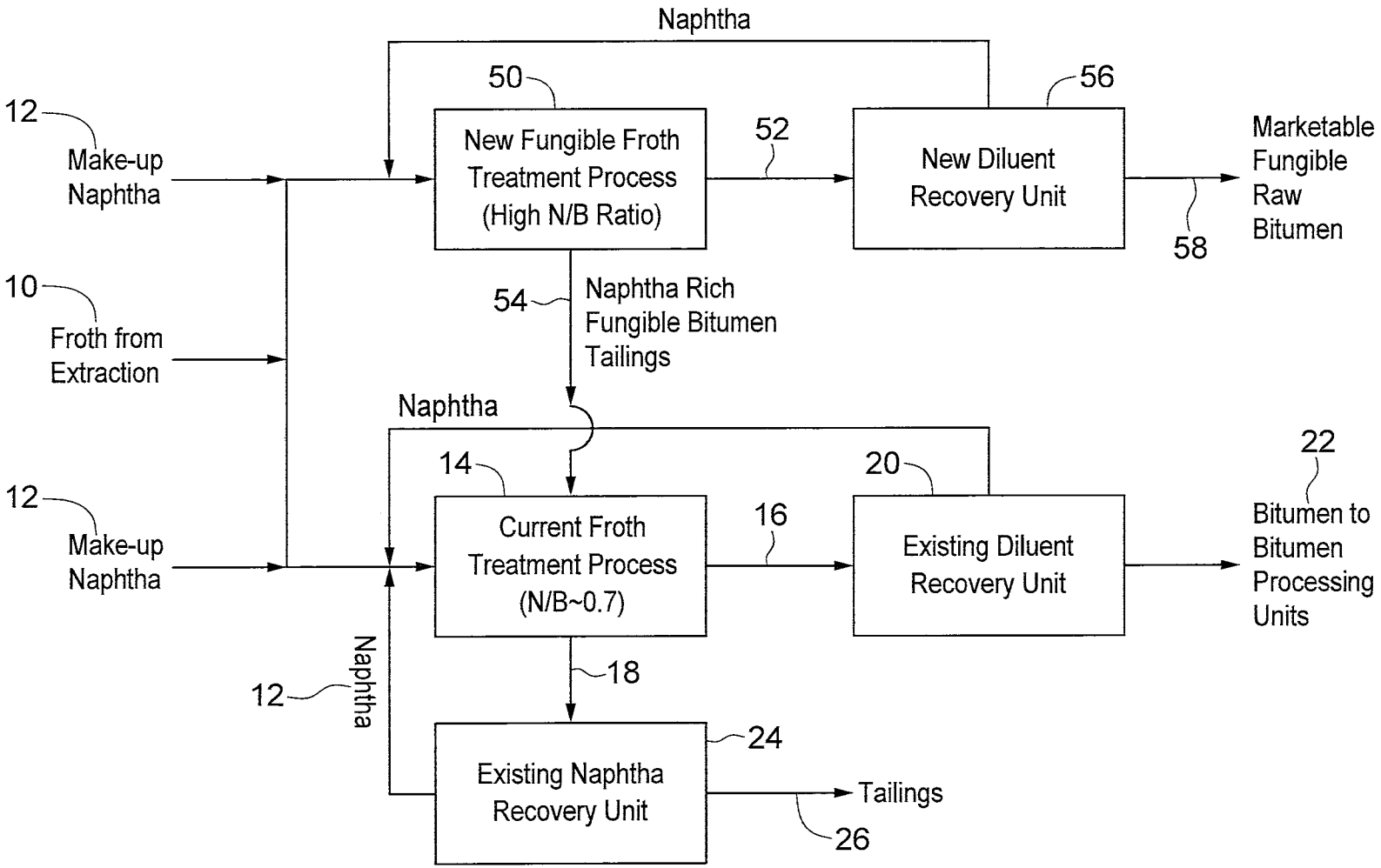
FIG. 3 is a schematic of another embodiment of the present invention for cleaning bitumen froth obtained from oil sand extraction.

FIG. 3 is a schematic of another embodiment of the process of the present invention for producing marketable fungible raw bitumen. In this embodiment, bitumen froth (10) from oil sand extraction is directly fed with naphtha (12) to give a naphtha-to-bitumen ratio of about 4.0 (w/w) to about 10.0 (w/w). The resulting mixture is subjected to either gravity or centrifugal separation (50). Preferably, gravity settling is carried out using an inclined plate separator to produce an overhead stream of diluted bitumen component (52) and a naphtha-rich underflow stream (54). Recovery of the solvent from the diluted bitumen component in a recovery unit (56) is conducted. Light hydrocarbons, e.g., condensate or synthetic crude, is the added to the product of recovery unit (56) before the marketable fungible raw bitumen is delivered to a pipeline or refinery (58), thereby meeting the required density and viscosity specification for the pipeline product. Naphtha (12) from the new diluents recovery unit (56) can be reused. The naphtha-rich underflow stream (54) from either gravity or centrifugal separation may be recycled as a naphtha source in the current bitumen froth treatment process.

Exemplary embodiments of the present invention are described in the following Examples, which are set forth to aid in the understanding of the invention, and should not be construed to limit in any way the scope of the invention as defined in the claims which follow thereafter.

Example 1

An experimental run was conducted in which bitumen froth was directly fed with naphtha at various naphtha-to-bitumen ratios. The average froth compositions based on duplicate samples were 49.3% bitumen, 36.1% water and 14.6% solids. The naphtha-based froth treatment processes were simulated using a standard jar test for gravity based process and cold spin test for the centrifuge based process. Diluted bitumen water content was determined by Karl-Fischer titration. The percent water in diluted bitumen was based on an average of two samples. The results are summarized in Table 1:

TABLE 1

| | Weight Percent Water in Diluted Bitumen | |
|---|---|---|
| Naphtha-to-Bitumen Ratio | Gravity-Based Separation (wt %) | Centrifuge-Based Separation (wt %) |
| 0.7 | 3.67 | 2.44 |
| 2.0 | 1.04 | 0.64 |
| 4.0 | 0.35 | 0.18 |
| 10.0 | 0.01 | N/A |

The results in Table 1 show that as the naphtha-to-bitumen ratio increases, the percent water in the diluted bitumen decreases for both the gravity and centrifuge-based separation. For comparison, a naphtha-to-bitumen ratio of 0.7 is commercially used to produce diluted bitumen typically with a water content ranging between 2.0 to 4.0 wt % and a solids content ranging between 0.5 to 1.0 wt %. Both water contents for the gravity and centrifuge-based separation fall within this range. However, the average diluted bitumen with a water content of 0.01 wt % was achieved at a naphtha-to-bitumen ratio of 10 for the gravity-based separation.

Example 2

Figure 4:
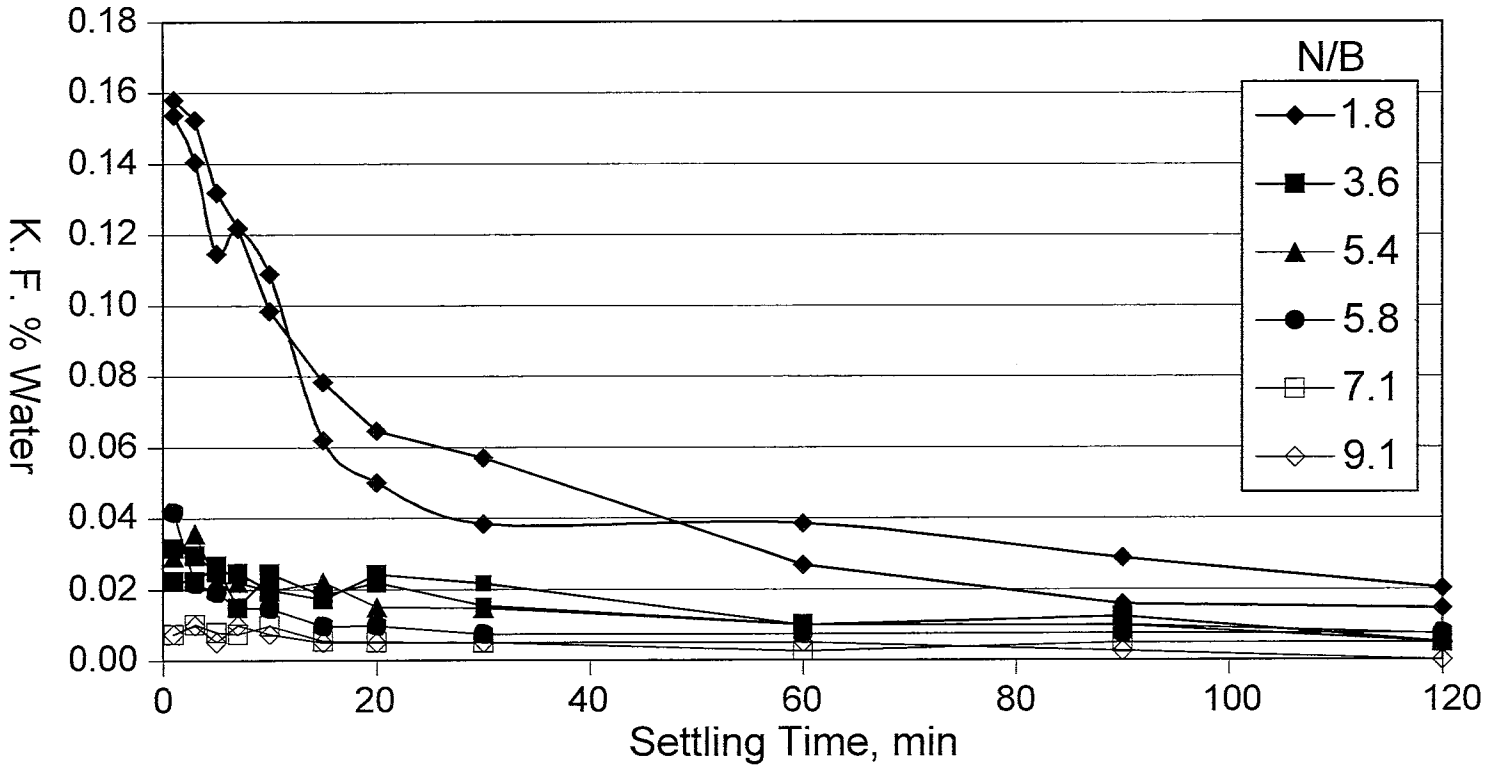
FIG. 4 is a graph showing the concentration of water (expressed as percentage and as measured by the Karl Fischer titration) in the fungible bitumen product at various time intervals (minutes) during settling.

An experimental run was conducted in which diluted bitumen obtained from an IPS unit was directly fed with naphtha at various naphtha-to-bitumen ratios. Diluted bitumen at a naphtha-to-bitumen ratio of about 0.7 was obtained from an IPS unit. In this sample, the average IPS product contained about 2 wt % water and about 1 wt % solids. The naphtha-based fungible bitumen process was simulated using a standard jar test for the gravity based process. The water content in the diluted bitumen was determined by Karl-Fischer titration. The percent water in fungible bitumen product as a function of settling time is presented in FIG. 4.

Figure 5:
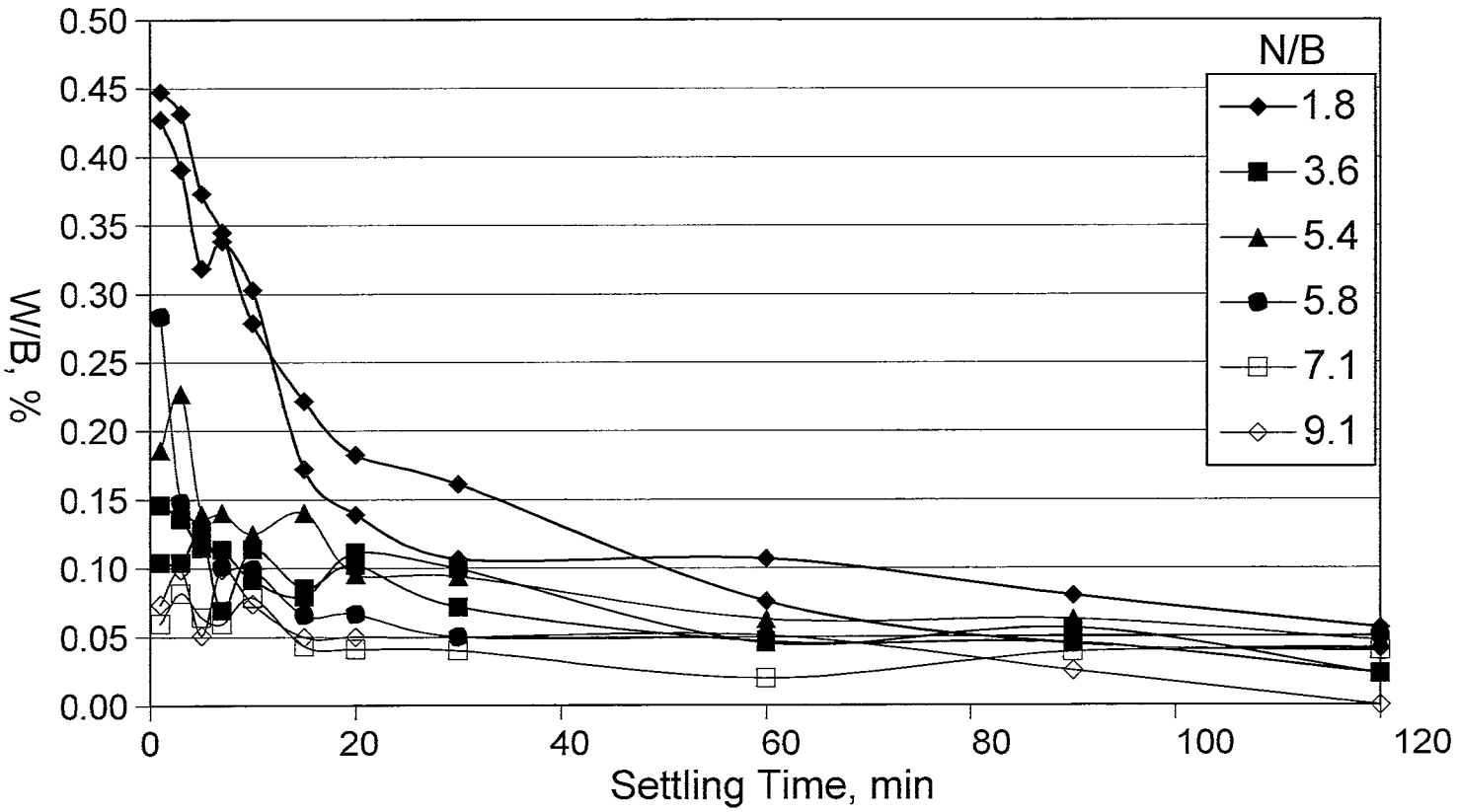
FIG. 5 is a graph showing the concentration of water to bitumen (expressed as percentage) in the fungible bitumen product at various time intervals (minutes) during settling.

The results show that as the naphtha-to-bitumen ratio increases, the percent water in diluted bitumen decreases. The fungible bitumen water and solids content of 0.5 vol % or less was achieved at a naphtha-to-bitumen ratio of 1.8 for the gravity based process. Achieving the required specification was not attributable to a dilution effect as demonstrated by re-plotting FIG. 4 to exclude the dilution effect. As shown in FIG. 5, the results support that the fungible bitumen process can achieve the required specifications.

Example 3

In this example, diluted bitumen obtained from convention bitumen froth treatment when using inclined plate settlers is used as the feed and mixed with various amounts of naphtha to give naphtha-to-bitumen ratios of about 1.8 to about 9.07. The resultant further diluted bitumen component was analyzed for both water content and solids content. The results are shown in Table 2.

TABLE 2

| Average N/B | Water, wt % | Solids, wt % | Hydrocarbon, wt % | Bitumen, wt % | Naphtha, wt % | Water to Bitumen, vol % | Solids to Bitumen, vol % | Sum of (Water + Solids)/ Bitumen, vol % |
|---|---|---|---|---|---|---|---|---|
| 1.80 | 0.017 | 0.09 | 99.893 | 35.664 | 64.229 | 0.049 | 0.25 | 0.30 |
| 3.63 | 0.005 | 0.05 | 99.945 | 21.596 | 78.349 | 0.023 | 0.23 | 0.25 |
| 5.37 | 0.007 | 0.05 | 99.943 | 15.697 | 84.246 | 0.047 | 0.32 | 0.37 |
| 5.80 | 0.007 | 0.06 | 99.933 | 14.687 | 85.245 | 0.051 | 0.41 | 0.46 |
| 7.08 | 0.005 | 0.04 | 99.955 | 12.375 | 87.580 | 0.040 | 0.32 | 0.36 |
| 9.07 | 0.000 | 0.02 | 99.980 | 9.930 | 90.050 | 0.000 | 0.20 | 0.20 |

As can be seen in Table 2, even at N/B ratios as low as 1.8, the diluted bitumen product consists of 0.017 wt % water and 0.09 wt % solids. The vol % of the sum of the water and solids to bitumen was less than 0.5 vol % for naphtha-to-bitumen ratios ranging from about 1.8 to about 9.07. Thus, the products are all fungible bitumen products which can be directly pipelined to conventional refineries for further treatment.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

REFERENCES

The following references are incorporated herein by reference (where permitted) as if reproduced in their entirety. All references are indicative of the level of skill of those skilled in the art to which this invention pertains.

Czarnecki, J. and Moran, K. (2005) On the stabilization mechanism of water-in-oil emulsions in petroleum systems. Energy & Fuels 19:2074-2079.

Kotlyar, L. S., Sparks, B. D., Woods, J. R. and Chung, K. H. (1999) Solids associated with the asphaltene fraction of oil sands bitumen. Energy & Fuels 13(2):346-350.

Moran, K., Cymerman, G. and Tran, T. Method for treatment of bitumen froth with high bitumen recovery and dual quality bitumen production. United States Patent Application Publication No. 2010/0012555 A1, published Jan. 21, 2010.

Renouf, G., Ranganathan, R., Scoular, R. J. and Soveran, D. (1997) The impact of changing Canadian pipeline BS & W specifications: a survey. Petroleum Society of CIM, Petroleum Conference of the South Saskatchewan Section. October 19-22. Paper No. 97-179.

Yang, X. and Czarnecki, J. (2002) The effect of naphtha to bitumen ratio on properties of water in diluted bitumen emulsions. Colloids and Surfaces A: Physicochem. Eng. Aspects 211:213-222.

The invention claimed is:

1. A process for cleaning bitumen froth produced from an oil sands extraction process, comprising:

mixing a sufficient amount of naphtha with the bitumen froth to provide a naphtha-to-bitumen ratio within the range of about 4.0 (w/w) to about 10.0 (w/w); and subjecting the resulting mixture to gravity settling or centrifugal separation to yield a hydrocarbon phase comprising substantially dry and substantially solids-free fungible bitumen and a separate water/solids phase.

2. The process of claim 1, wherein the hydrocarbon phase comprising fungible bitumen comprises a water concentration between about 0.01 wt % to about 0.35 wt %.

3. The process of claim 1, wherein the naphtha-to-bitumen ratio is about 10 (w/w).

4. The process of claim 3, wherein the hydrocarbon phase is separated from the water/solids phase through gravity settling.

5. The process of claim 4, wherein the hydrocarbon phase comprising fungible bitumen comprises about 0.01 wt % water or less.

6. A process for cleaning bitumen froth produced from an oil sands extraction process, comprising:

mixing a sufficient amount of naphtha with the bitumen froth to provide a naphtha-to-bitumen ratio of about 0.7 (w/w);

subjecting the resulting first mixture to gravity settling or centrifugal separation to yield a hydrocarbon phase comprising diluted bitumen;

mixing a sufficient amount of naphtha with the hydrocarbon phase comprising diluted bitumen to provide a naphtha-to-bitumen ratio equal to or greater than about 1.8 (w/w) and form a second mixture; and subjecting the resulting second mixture to gravity settling or centrifugal separation to yield a hydrocarbon phase comprising fungible bitumen, and a separate water/solids phase.

7. The process of claim 6, wherein the hydrocarbon phase comprising diluted bitumen comprises about 2 wt % water and about 1 wt % solids.

8. The process of claim 6, wherein the first mixture and the second mixture are subjected to gravity settling.

9. The process of claim 8, wherein gravity settling is conducted for about 20 minutes to about 2 hours.

10. The process of claim 9, wherein the hydrocarbon phase comprising fungible bitumen comprises less than about 0.5 wt % water.

11. The process of claim 6, wherein the water content of the hydrocarbon phase comprising fungible bitumen is about 0.017 wt % or less.

12. The process of claim 6, wherein the solids content of the hydrocarbon phase comprising fungible bitumen is about 0.09 wt % or less.

13. The process of claim 6, wherein the sum of the water content and the solids content in the hydrocarbon phase comprising fungible bitumen is less than about 0.5 vol %.

14. The process of claim 6, wherein the amount of naphtha mixed with the hydrocarbon phase comprising diluted bitumen provides a naphtha-to-bitumen ratio in the range of about 1.8 (w/w) to about 9.0 (w/w).

15. A process for cleaning bitumen froth produced from an oil sands extraction process, comprising:

mixing a sufficient amount of naphtha with a first portion of the bitumen froth to provide a naphtha-to-bitumen ratio within the range of about 4.0 (w/w) to about 10.0 (w/w) and form a first mixture;

subjecting the resulting first mixture to gravity settling or centrifugal separation to yield a hydrocarbon phase comprising a first fungible bitumen and naphtha rich tailings;

mixing a sufficient amount of the naphtha rich tailings and, optionally, additional naphtha with a second portion of the bitumen froth to provide a naphtha-to-bitumen ratio of about 0.7 (w/w) and form a second mixture; and subjecting the resulting second mixture to gravity settling or centrifugal separation to yield a hydrocarbon phase comprising a bitumen product and a separate water/solids phase.

16. The process as claimed in claim 15, further comprising:

mixing a sufficient amount of naphtha with the hydrocarbon phase comprising a bitumen product to provide a naphtha-to-bitumen ratio equal to or greater than about 1.8 (w/w) and form a third mixture; and subjecting the resulting third mixture to gravity settling or centrifugal separation to yield a hydrocarbon phase comprising a second fungible bitumen and a separate water/solids phase.

17. The process of claim 16, wherein the first mixture and second mixture is subjected to gravity settling.

18. The process of claim 17, wherein gravity settling is conducted for about 20 minutes to about 2 hours.

19. The process of claim 16, wherein both the hydrocarbon phase comprising the first fungible bitumen and the hydrocarbon phase comprising the second fungible bitumen comprises less than about 0.5 wt % water.

20. The process of claim 16, wherein the water content of both the hydrocarbon phase comprising the first fungible bitumen and the hydrocarbon phase comprising the second fungible bitumen is about 0.017 wt % or less.

21. The process of claim 16, wherein the solids content of both the hydrocarbon phase comprising the first fungible bitumen and the hydrocarbon phase comprising the second fungible bitumen is about 0.09 wt % or less.

22. The process of claim 16, wherein the sum of the water content and the solids content in both the hydrocarbon phase comprising the first fungible bitumen and the hydrocarbon phase comprising the second fungible bitumen is less than about 0.5 vol %.

23. The process as claimed in claim 15, further comprising:

subjecting the hydrocarbon phase comprising bitumen product to further processing in a refinery.

* * * * *